United States Patent [19]

Petersson

[11] 4,447,963

[45] May 15, 1984

[54] METHOD FOR PRODUCING A FUEL FROM SOLID BITUMINOUS AND/OR LIGNOCELLULOSIC MATERIAL

[75] Inventor: Stig A. Petersson, Skelleftehamn, Sweden

[73] Assignee: Boliden Aktiebolag, Stockholm, Sweden

[21] Appl. No.: 350,244

[22] Filed: Feb. 19, 1982

[30] Foreign Application Priority Data

Mar. 13, 1981 [SE] Sweden ..... 8101623

[51] Int. Cl.[3] ..... F26B 3/00; F26B 7/00; C10L 5/00

[52] U.S. Cl. ..... 34/12; 44/10 G; 44/10 J

[58] Field of Search ..... 34/9, 12; 44/10 G, 10 J, 44/33, 33.1, 32, 32.1

[56] References Cited

U.S. PATENT DOCUMENTS

| | | | |
|---|---|---|---|
| 390,546 | 10/1888 | Aikman | 44/32 |
| 1,960,917 | 5/1934 | Nagelvoort | 34/9 |
| 3,680,217 | 8/1972 | Chapman | 34/61 |

*Primary Examiner*—John J. Camby

*Attorney, Agent, or Firm*—Stevens, Davis, Miller & Mosher

[57] ABSTRACT

The invention relates to a method for producing fuel from solid bituminous or lignocellulosic material. The material is charged, optionally continuously, to a closed vessel together with oil heated to a temperature in excess of 65° C., preferably in excess of 75° C. A total gas pressure of 5–50 kPa is maintained in the vessel. The material and oil are removed from the vessel, optionally also continuously, and separated by mechanical means, for example by means of rolls, to press the oil from the material. The separated oil is returned to the process.

6 Claims, 1 Drawing Figure

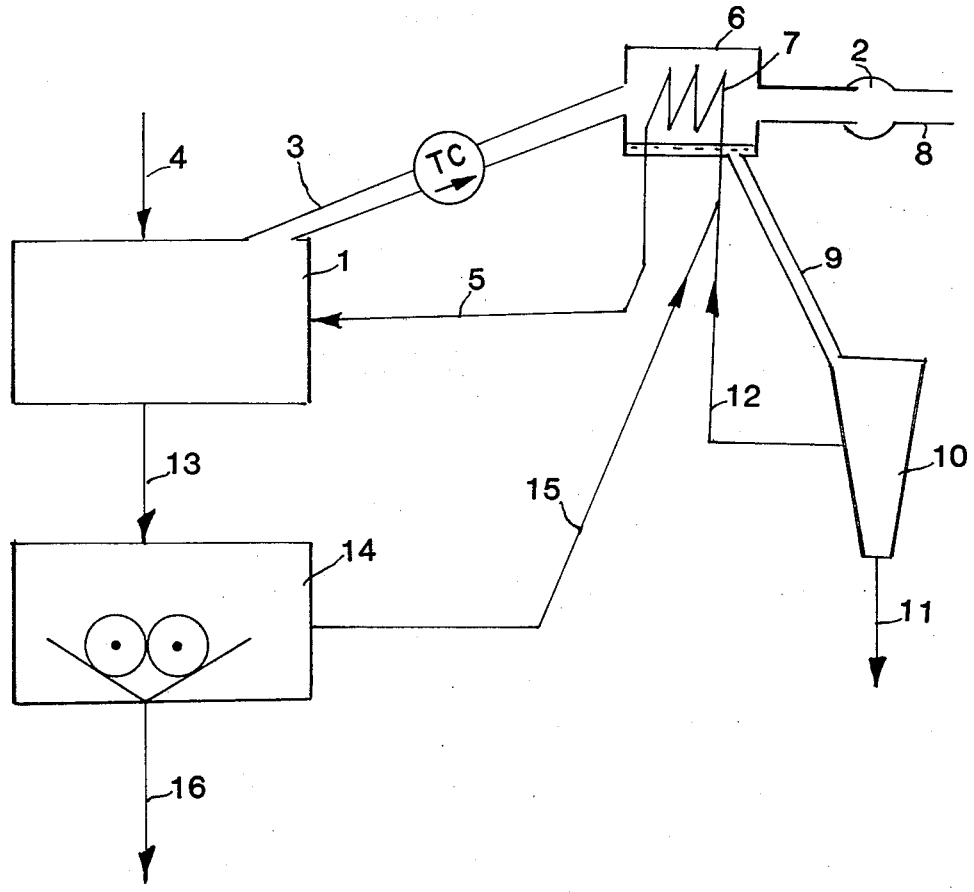
FIG

METHOD FOR PRODUCING A FUEL FROM SOLID BITUMINOUS AND/OR LIGNOCELLULOSIC MATERIAL

DESCRIPTION

TECHNICAL FIELD

The present invention relates to a method for producing a fuel from solid bituminous and/or lignocellulosic material, in which said material is de-watered with a hot, liquid hydrocarbon, preferably oil, having a higher boiling point than water, under reduced pressure; and in which the major part of the hydrocarbon is separated from the material and the hydrocarbon recycled to the dewatering stage.

BACKGROUND OF THE INVENTION

The German Patent Specification No. 256653, published in 1912, describes a method of drying solid bodies in which the bodies are immersed in a liquid heated to a temperature in excess of 100° C.

The Swedish Patent Specification No. 321 195, published in 1970 describes a method for drying metal oxides in which the metal oxide is immersed in finely-divided form into a liquid hydrocarbon which is heavier than water, thereby to displace the water from the oxide. This specification recommends that the mixture is heated to a temperature of approximately 100° C.

In a method described in U.S. Pat. No. 2,236,445, coal is dried by immersing the coal in a hot liquid.

These specifications clearly show that the technique of drying material by displacing water therefrom with the aid of a liquid is well known. It is, of course, also known to remove water from a material by heating the material.

Finally, it is also known to remove water and moisture from materials, by exposing the materials to a pressure beneath ambient or atmospheric pressure; for example many vacuum-drying methods are known to the art.

All known drying methods, however, require energy or are expensive to carry out, and there is a great need for drying methods and dewatering methods by means of which moist bituminous and lignocellulosic materials can be dried to form suitable fuels at a cost which is sufficiently low for these materials to compete with oil and high-grade coal. Before the price of oil began to rise at the beginning of the 1970's, there was very little interest in using alternative energy sources. The price of oil can hardly be expedted to fall in the future. Because of this, efforts are being made to find other energy sources, and particularly other fuels capable of replacing oil. Deposits of high-grade coal are limited and consequently efforts have been made to utilize low-grade carbonaceous fuels, such as peat, brown coal and forest waste. The water contained by these materials constitutes a problem when using the same as fuels.

Consequently there is a great need for new de-watering methods in the producton of fuels, in which methods the criterion of low energy costs is of the highest importance.

DISCLOSURE OF THE PRESENT INVENTION

It has now been found that bituminous and lignocellulosic material, and in particular peat and forest refuse can be advantageously dewatered by bringing the material into contact with a water-immiscible liquid product based on hydrocarbon and having a higher boiling point than water, at an elevated temperature of between about 35° to 80° C. in a closed vessel in which the total pressure in maintained beneath atmospheric pressure, 100 kilo pascal, preferably between 5–50 kilo pascal. The hydrocarbon used is suitably an oil product, preferably kerosene (paraffin) and oil having a boiling point of 150° C. or higher.

The temperature is suitably maintained at a level above the boiling point of water at the pressure used in the de-watering vessel, and is at least about 35° C. at 5 kilo pascal and at least about 80° C. at 50 kilo pascal. For reasons concerning the technical nature of the apparatus used it is preferred, when carrying out the invention, that the pressure in the de-watering vessel is about 9.5 to 31 kPa and the temperature about 45°–70° C., more preferably the pressure is 12 to 20 kilo pascal, and the temperature is about 50° to 60° C.

The moisture content of the material to be dewatered can be so high that it is almost dripping of water. Normally, however, the material is pressed to remove entrapped water, whereby the water content of a peat is brought down to 57%. In a standard pit coal product having been floatated the moisture content is about 30%. The water content can, however, be at least up to 80%.

The temperature of the liquid hydrocarbon being brought into contact with the material to be de-watered should be at least 30° to 50° C. above that of said material.

The method will now be described in more detail with reference to the accompanying drawing, the single FIGURE of which illustrates a dewatering vessel 1 arranged so that the pressure therein is lower than atmospheric pressure. Air and steam departing from the vessel are pumped by means of a vacuum pump 2 through a line 3. Bituminuous or lignocellulosic material is introduced into the vessel 1 through a line 4 via a feed valve (not shown). Hot oil is passed to the dewatering container 1 through a line 5 and is mixed in said container with the material supplied thereto through line 4. The major part of the water accompanying the material is thereby vapourized and departs through the line 3 and the pump 2. The thus removed gas is cooled with cold oil in a cooling coil 7 arranged in a cooler 6. Residual gas is discharged via a line 8. Alternatively, the vapourized gas is removed via a thermo compressor (not shown) arranged in the line 3, whereby the pressure of the gas is brought to atmospheric pressure, 101 kilo pascal, and the temperature is simultaneously increased. For example the temperature in the reactor is 50° C. and the pressure is 12 kilo pascal, whereby the temperature of the gas is increased to about 320° C. and the pressure is increased to 101 kilo pascal. After heat exchange with infeed oil the gas is removed via line 8. Thereby the pressure in the cooler/heat exchanger will be maintained at atmospheric. Vapourized water is condensed in the cooler 6 together with a certain amount of oil, this condensate being passed to a separating means 10 through a line 9, where oil and water are separated from one another. The water is passed to suitable purifying means (not shown) through a line 11, and the oil is returned to the oil circulating in the system, through a line 12.

The material heated with hot oil is passed through a line 13 to an oil-expelling means 14, suitably a mechanical means, where the oil is pressed from the material and recirculated through a line 15, the cooler 6 and the line 5. A fuel which is ready for use is removed through a line 16.

The resultant fuel will have a very low moisture content and will contain a certain amount of oil. The amount of oil permitted to remain in the fuel will depend upon the decisions reached when considering the price of oil and the costs of removing the oil from the material. When drying peat, for example, the amount of oil remaining in the material should be about 5–15%. Since the usefulness of the fuel can be increased by increasing the amount of oil contained therein, it may be suitable to permit some of the oil to accompany the fuel. As will be understood, the oil accompanying the fuel out of the system must constantly be replaced with further oil, this replacement suitable being effected together with the material supplied to the system. This affords the advantage of binding the dust in the material.

In certain cases it may be suitable, and desirable, for the fuel to contain relatively high residual contents of oil. One example of this is when de-watering coal-water-slurries obtained when wet-dressing black coal in order to separate impurities therefrom, for example metal sulphides. A coal-oil-product often has an attractively high calorific value, and also lends itself to transportation and storage. Such a product can be burned in oil-fired plants.

The de-watering vessel 1 suitably has the form of an autoclave. The moist material can be charged to the autoclave either batchwise or continuously, by means of a conveyor provided with suitable valve arrangements for equalizing the pressure. Thus, the material can be enclosed in liquid-permeable baskets or the like, in order to prevent the material from forming a slurry with the oil.

Subsequent to treating the material in the de-watering vessel, the oil is removed in the oil-dispelling means, which suitably has the form of one or more pairs of rolls, between which the material is caused to pass. Thus, peat can readily be rolled to an extent such that the residual oil content of the peat lies in the order of 5–15%. Alternatively, conventional presses of the kind used in the manufacture of peat briquettes may be used. The pump may be a conventional piston pump, a liquid pump or an injector pump.

Residual moisture after the treatment can be 1 to 10% of water, depending on what type of material is treated.

The method according to the invention will now be illustrated with reference to a working example, in which a test plant was operated with the following balance of material and energy.

Residual oil content can be further decreased to below 1% by a simple evaporation of the oil by blowing of air over the material while being stirred.

EXAMPLE 1

1 kg of peat containing 51% water was charged to an autoclave together with about 8 kg oil having a temperature of 140° C. The pressure in the autoclave was set to 25 kilo pascal, whereat 0.5 kg water was displaced and 1.0 kg peat, containing 0.5 kg oil and 0.01 kg water was removed from the autoclave at a temperature of 65° C. The peat was passed to a rolling press, where 0.425 kg oil was pressed from the peat, which now contained 490 kg dry peat, 75 g oil and 10 g water. The vapourized water was discharged through a vacuum pump, whereat the temperature was raised from 65° C. to 200° C. 7.5 kg oil having a temperature of 65° C. were removed from the autoclave and subjected to a heat exchange with gas downstream of the vacuum pump, the temperature being increased to 105.5° C. while the temperature of the gas fell to 110° C. The hot gas was used to heat the incoming oil to a temperature of about 65° C. When carrying out this test, the only energy supplied was that supplied through the vacuum pump and by increasing the temperature of the oil from 105.5° C. to 140° C. with hot flue gases from a peat combustion furnace. The flue gases were also used to heat the air charged to the furnace. Of the energy supplied in the form of peat and 15% oil in the fuel produced, 88% could be utilized as fuel. 12% of the energy supplied was used to produce the fuel.

EXAMPLE 2

1000 kg of black coal having been floatated to remove sulphur and other unwanted constituents and containing 30% of water were charged to an autoclave together with about 2.5 $m^3$ of kerosene having a temperature of 200°C. The pressure in the autoclave was set to 12 kilo pascal, whereat 300 kg of water were displaced and 900 kg of coal containing 200 kg of kerosene and 9 kg of water were removed. The coal was transferred via a roller, thereby reducing the kerosene content to 5% to an evaporator through which air at ambient temperature was blown and the kerosene content was reduced to less than 1%. The kerosene was removed from the evaporator and transferred to an adsorption apparatus, from which the kerosene was evaporated by means of steam and reintroduced into the process. The vapourized gas from the autoclave was drawn off and its pressure and temperature was increased by means of a thermo compressor to 101 kPa and 320° C. and used to heat the oil used in the process. A bleed from said latter vapour was used to evaporate the kerosene from the adsorber.

The final product comprises 700 kg of coal containing less than 9 kg of water and considerably less than 9 kg of kerosene. The product is free flowing.

I claim:

1. A method for producing fuel from solid lignocellulosic material, comprising charging said material to a closed vessel together with a substantially liquid product based on hydrocarbon; maintaining in said vessel a pressure of 12 to 20 kilo Pascal; said hydrocarbon liquid product having a higher boiling point than water and having a temperature of above 60° C., said temperature further being at least 30° C. above the temperature of the water vapour related to the actual pressure, removing the material and liquid hydrocarbon product from the vessel, passing said material between rolls to separate liquid hydrocarbon product from said material, over-blowing said material with air to remove substantial remaining contents of said hydrocarbon product; removing water vapour from said material, thermo compressing said removed water vapour to increase the pressure to 101 kilo Pascal and its temperature to about 320° C., and heat exchanging an ingoing quantity of liquid hydrocarbon product with said compressed and heated vapours to heat said liquid hydrocarbon product to a temperature as given.

2. A method according to claim 1, characterized in that the substantially liquid product is oil having a temperature above 75° C.

3. A method according to claim 2, characterized in that subsequent to treating said material with said oil the material is passed between rolls in order to separate oil from the solid material.

4. A method according to claim 1, characterized in that the pressure is 9.5 to 31 kilo Pascal and the temperature then is 45°–70° C.

5. A method according to claim 4, characterized in that the pressure is 12 to 20 kilo Pascal and the temperature then is 50°–60° C.

6. A method according to claim 2, 3, 4, 5 or 1, characterized in that the hydrocarbon containing material is subjected to overblowing with air to remove the substantial remaining contents of said hydrocarbon.

* * * * *